US005915621A

United States Patent [19]

Yanagida et al.

[11] Patent Number: 5,915,621

[45] **Date of Patent: *Jun. 29, 1999**

[54] ELECTROSTATIC POWDER COATING METHOD AND APPARATUS

[75] Inventors: Kenzo Yanagida; Masahiro Yamamoto; Mituyosi Kumata, all of Tokyo; Koichi Tsutsui; Shannon Libke, both of Osaka, all of Japan

[73] Assignees: Nippon Paint Co., Ltd., Osaka, Japan; Nihon Parkerizing Co., Ltd., Tokyo, Japan

[ * ] Notice: This patent is subject to a terminal disclaimer.

[21] Appl. No.: 08/951,467

[22] Filed: Oct. 16, 1997

Related U.S. Application Data

[62] Division of application No. 08/515,976, Aug. 16, 1995, Pat. No. 5,711,489.

[30] Foreign Application Priority Data

Aug. 18, 1994 [JP] Japan ..... 6-194430
Aug. 18, 1994 [JP] Japan ..... 6-194431

[51] Int. Cl.[6] ..... B05B 1/28; B05B 5/03; B05B 5/16

[52] U.S. Cl. ..... 239/3; 239/695; 239/707; 239/105

[58] Field of Search ..... 239/690, 708, 239/704–707, 105, 3, 697, 696, 695; 361/225, 226; 427/470, 475, 477, 479, 480, 533; 118/626–631

[56] References Cited

U.S. PATENT DOCUMENTS

| | | | |
|---|---|---|---|
| 2,421,787 | 6/1947 | Helmuth | 118/630 X |
| 2,465,128 | 3/1949 | Starkey | 118/630 X |
| 2,466,906 | 4/1949 | Miller | 118/630 X |
| 2,625,590 | 1/1953 | Peeps | 118/630 X |
| 2,698,814 | 1/1955 | Ransburg | 118/630 X |
| 2,933,414 | 4/1960 | Beck | 118/629 X |
| 3,093,309 | 6/1963 | Wantanabe | 239/696 X |
| 3,129,112 | 4/1964 | Marvin | 118/629 X |
| 3,323,934 | 6/1967 | Point | 118/630 X |
| 3,625,404 | 12/1971 | Probst | 222/193 |
| 3,873,024 | 3/1975 | Probst et al. . | |
| 4,228,961 | 10/1980 | Itoh | 239/105 X |
| 4,235,381 | 11/1980 | Vila | 239/696 |
| 4,289,278 | 9/1981 | Itoh | 239/105 X |
| 4,352,718 | 10/1982 | Grün | 159/48 R |
| 4,500,560 | 2/1985 | Guffroy . | |
| 4,772,982 | 9/1988 | Nagasaka . | |
| 5,711,489 | 1/1998 | Yanagida et al. | 239/697 |

FOREIGN PATENT DOCUMENTS

| | | |
|---|---|---|
| 0297520 A2 | 1/1989 | European Pat. Off. . |
| 0452152 A2 | 10/1991 | European Pat. Off. . |
| 1370305 | 9/1963 | France . |
| 2208312 | 4/1974 | France . |
| 2283729 | 4/1976 | France . |
| 2314775 | 1/1977 | France . |
| 27 55 189 A1 | 6/1979 | Germany . |
| 2018625A | 10/1979 | United Kingdom . |
| 2022464 A | 12/1979 | United Kingdom . |

*Primary Examiner*—Kevin Weldon
*Attorney, Agent, or Firm*—Armstrong, Westerman, Hattori, McLeland & Naughton

[57] ABSTRACT

An electrostatic powder coating gun for dispersing aggregate powder onto substrates. The gun includes swirling air passage outlets to form a vortex of air inside the spray gun tip to reduce powder adhesion and assist in pulverizing the powder material. The coating gun employs a powder supply unit having a fluidized bed that includes temperature and humidity controls to adjust the temperature and humidity of the compressed air supplied to the spray gun and a mixer to agitate the powder in the container.

22 Claims, 10 Drawing Sheets

ELECTROSTATIC POWDER COATING METHOD AND APPARATUS

This application is a divisional application of application Ser. No. 08/515,976 filed on Aug. 16, 1995, now U.S. Pat. No. 5,711,489.

BACKGROUND OF THE INVENTION

1. Field of the Invention

The present invention relates to an electrostatic powder coating method and apparatus which are suitably used for top coat of automobiles and decorative coating of steel-made furniture or the like.

2. Description of the Related Art

An electrostatic powder coating apparatus of prior art includes a powder supply unit and a spray gun. In the powder supply unit of prior art, as shown in FIG. 10, a fluid-bed type hopper 1 is partitioned by a porous resin plate 21 into an upper fluidizing container 1*a* and a lower air chamber 1*b*. The air chamber 1*b* is provided in its side with a fluidizing air supply port 3 through which compressed air A is supplied to the air chamber 1*b* and then to the fluidizing container 1*a* through the porous resin plate 21. With supply of the compressed air, powder 23 in the fluidizing container 1*a* is evenly mixed with the air, sucked from the fluidizing container 1*a* through an injector 9 for feeding to the spray gun 101, and then sprayed toward a product to be coated along with a flow of conveying air from a nozzle opening at the gun tip.

During a spraying process, a DC high voltage is applied to a pin type discharge electrode provided at the gun tip, so that monopolar ions are generated by corona discharge in the vicinity of the electrode.

When the powder passes by the electrode, powder particles are given with electric charges upon impingement against the ions. The charged powder particles are deposited by electrostatic forces on the product to be coated which is held at the grounded potential.

Then, the powder layer deposited on the product to be coated is finished into a coating film through the steps of melting and hardening performed in an atmosphere at high temperatures of about 150 to 250° C. Powders for use in electrostatic powder coating generally have an average particle size of 30 to 40 $\mu$m for easiness in handling.

The prior art powder supply unit described above have, however, problems below.

(1) Particularly for powders accompanying a difficulty in fluidization, such as fine particle powder or powder having large specific gravity, the powder and air are not well mixed with each other even if the amount of air is simply increased, and passages 24 allowing the air to pass therethrough are formed in a powder layer L. Therefore, most of the supplied air straightly blows through the powder layer L and, hence, the powder is not fluidized.

In that case, a fluidization accelerant is required to be added to the powder for improving fluidity thereof. However, such an improvement in property of the powder pushes up the cost of powder production. Further, the improvement in fluidity may cause drawbacks such as a reduction in charging ability and a deterioration in appearance of coating films.

(2) On the other hand, when a large amount of compressed air is used as fluidizing air, much of powder is expelled out of the powder container along with sprayed air and the rate of utilization of the powder is lowered. In the case of fine particle powder, particularly, the method of supplying a large amount of compressed air is not preferable because the amount of powder expelled out of the fluid-bed type hopper is increased.

(3) Of powders accompanying a difficulty in fluidization, fine particle powder is apt to easily aggregate above all and is hard to handle. Since fine particle powder has a larger surface area per unit mass than other usual powders, aggregation thereof is accelerated for the following factors:

a: aggregation based on electrostatic attractions between powder particles, b: aggregation by softening of powder particles at high temperatures, and c: aggregation through adsorbed water at high humidity.

Therefore, if powder in the fluid-bed type hopper is always fluidized by a large amount of compressed air, the friction between powder particles or between powder particles and the fluid-bed type hopper causes changes in physical properties of the powder, e.g., aggregation thereof, and an appearance of the coating film after the steps of coating and baking is adversely affected.

Also, using high-temperature or high-humidity compressed air as fluidizing air tends to easily cause changes in physical properties of powder, e.g., aggregation thereof, and hence adversely affect an appearance of the coating film after the steps of coating and baking as with the above case.

(4) The powder aggregated in the fluid-bed type hopper and the powder adhering in a powder feeding line extending from the supply unit to the spray gun are responsible for spitting and adversely affects an appearance of the coating film.

The spray gun of prior art has problems below.

As mentioned above, powders having an average particle size of 30 to 40 $\mu$m are generally used in electrostatic powder coating, but smoothness of coating films formed of such powders is fairly inferior to that formed by solvent based coating. For this reason, powder coating has not been widely employed in the field where decorative coating films having good smoothness is required, e.g., in top coat of automobile bodies and steel-made furniture.

In the electrostatic powder coating method, smoothness of a coating film can be improved by, e.g., thickening the coating film, improving fluidity of powders, or making up powders of fine particles.

However, thickening the coating film gives rise to problems of an increase in the coating cost due to the increased amount of powder used and a deterioration in appearance of the coating film due to generation of electrostatic repulsion.

In order that powders having an average particle size of 30 to 40 $\mu$m provide smoothness comparable to that obtainable by solvent based coating without thickening the coating film, it is thought to improve fluidity of powders. But this method causes the coating film to easily sag during the baking step, and eventually deteriorates an appearance of the coating film.

On the other hand, if fine particle powders having an average particle size not greater than 25 $\mu$m, preferably in the range of 5 to 20 $\mu$m, are used, smoothness of the coating film is improved, thinning of the coating film is enabled, and a reduction in the coating cost is also expected.

However, easiness in handling fine particle powders is considerably worsened as follows, making it very difficult to handle fine particle powders by commercially available electrostatic powder coating apparatus.

Even if such powder can be coated, satisfactory properties of the coating film are not obtained in points of evenness and appearance of the coating film because of a difficulty in stable supply of the powder and aggregation of the powder.

(1) The powder having a small particle size is strongly affected by electrostatic forces, and adhesion forces of fine particles are increased. As a result, the fine particles of the powder are apt to aggregate together or adhere to a powder supply tube, a powder spray gun and so on. Therefore, the powder having a small particle size accompanies a difficulty in stable supply to the spray gun, and the coating film cannot have an even thickness.

(2) The aggregated powder or the powder peeled off from the powder supply tube and the spray gun adheres to the product surface to be coated in the form of lumps, which considerably mar an appearance of the coating film.

(3) As the particle size of the powder is reduced, the transfer efficiency of powder onto the product to be coated is greatly affected by the amount of air sprayed from the spray gun.

Thus, the powder reaching the product to be coated is blown away in a considerably amount by the flow of conveying air and, eventually, the transfer efficiency is lowered.

As explained above, fine particle powders are more strongly affected by aerodynamic forces of powder conveying air and electrostatic forces. One simple method of increasing the transfer efficiency by the use of existing coating apparatus is to reduce the amount of powder sprayed per gun. Specifically, with a reduction in the amount of powder sprayed, the amount of conveying air is reduced and the charging rate is increased, which results in the improved transfer efficiency. But, if the amount of powder sprayed per gun is reduced, the number of spray guns must be increased because the amount of powder to be deposited for coating a product is unchanged. This is not preferable from the viewpoint of equipment cost.

Furthermore, in multilayer coating, there occur other problems such as a reduction in the transfer efficiency and generation of electrostatic repulsion by the coating film. A description will be made below of the case of coating automobile bodies as a typical example of multilayer coating.

A coating film for automobile bodies is formed of a multilayer coating film in three or four layers comprising: an electro-coat, an primer surfacer, and a top coat (a combination of base coating and clear top coating) which are laminated successively in this order.

Those layers except the electro-coat and the metallic base coating can be formed by powder coating. But since coating films one over another is subjected to greater electrostatic limitations than the case of coating a film directly on a metal-made product, there arise problems such as a reduction in the transfer efficiency and texture roughing of the coating film caused by electrostatic repulsion.

For example, when electrostatic coating is made on a product having an under coat already formed thereon by applying a high voltage of about −80 kV to the spray gun, the surface of the under coat of the product to be coated traps electric charges of ions flying from the spray gun and, hence, the surface charge density of the product to be coated is raised.

Therefore, the surface potential of the product to be coated becomes as high as minus several kV, causing electrostatic repulsion between charged powder particles sprayed toward the product to be coated from the spray gun and the product to be coated. This reduces the transfer efficiency. Electrostatic repulsion is also caused between the powders deposited on the product to be coated. As a result, a disadvantage in appearance of the coating film, i.e., roughing of the film texture, is more likely to occur.

In view of the state of art as set forth above, an object of the present invention is to realize fluidization of powder that is difficult to fluidize, and supply such powder to a spray gun stably. Another object of the present invention is to coat fine particle powder evenly on the surface of a product to be coated without causing aggregation of the powder, and form a coating film having good smoothness. Still another object of the present invention is to coat a film on a product, which has an under coat already formed thereon, with high transfer efficiency, and form a coating film which is free from texture roughness and has good smoothness.

SUMMARY OF THE INVENTION

According to one aspect of the present invention, in an electrostatic powder coating apparatus comprising a spray gun and a powder supply unit, the apparatus being adapted to form a coating film by spraying electrostatically charged powder toward the surface of an electrically grounded product to be coated, a nozzle tip of the spray gun includes means for pulverizing and dispersing the aggregated powder. The pulverizing and dispersing means comprises, for example, vortex air introduction ports and a diffuser.

According to another aspect of the present invention, in an electrostatic powder coating apparatus comprising a spray gun and a powder supply unit, the apparatus being adapted to form a coating film by spraying electrostatically charged powder toward the surface of an electrically grounded product to be coated, a nozzle tip of said spray gun includes powder adhesion preventing means. The powder adhesion preventing means is, for example, compressed air supplied to the powder flow passage inside the nozzle tip for cleaning an inner surface of the nozzle tip.

According to still another aspect of the present invention, in an electrostatic powder coating apparatus comprising a spray gun and a powder supply unit, the apparatus being adapted to form a coating film by spraying electrostatically charged powder toward the surface of an electrically grounded product to be coated, the apparatus includes means for forming a flow of a vortex air in the powder flow passage of the nozzle tip of the spray gun, and corona discharge means to which is applied a voltage with opposite polarity to the voltage applied to the spray gun, the discharge means being disposed upstream of the spray gun in the direction of conveyance of products to be coated.

For the product to be coated having an under coat formed thereon, particularly, means for suppressing an increase in the surface potential of the under coat and preventing the occurrence of electrostatic repulsion is used in combination with the aforesaid coating apparatus.

According to still another aspect of the present invention, in an electrostatic powder coating apparatus comprising a spray gun and a powder supply unit, the apparatus being adapted to form a coating film by spraying electrostatically charged powder toward the surface of an electrically grounded product to be coated, the apparatus includes means for forming a flow of a vortex air in the powder flow passage of the nozzle tip of the spray gun, corona discharge means to which is applied a voltage with opposite polarity to the voltage applied to the spray gun, the discharge means being disposed upstream of the spray gun in the direction of conveyance of the product to be coated, control means for adjusting a temperature and humidity of compressed air supplied to the air chamber of the powder supply unit, and means for stirring the powder in the fluidizing container of the powder supply unit.

According to still another aspect of the present invention, in an electrostatic powder coating method by which powder supplied from a powder supply unit is sprayed from a nozzle tip of a spray gun toward an electrically grounded product to be coated, a product to be coated having an under coat formed thereon is subjected to electrostatic repulsion preventing treatment beforehand, and the powder is coated while forming a flow of a vortex air in a powder flow passage inside the nozzle tip of the spray gun.

The electrostatic repulsion preventing treatment is effected by, for example, a method of exposing products to be coated to an electric field with opposite polarity to the spray gun for charging the surface of the under coat beforehand.

According to still another aspect of the present invention, in an electrostatic powder coating apparatus in which a fluid-bed type hopper is vertically partitioned by a porous member to define therein an upper fluidizing container and a lower air chamber, and compressed air supplied to the air chamber flows into the fluidizing container through the porous member for fluidizing the powder, the apparatus includes temperature/humidity control means for adjusting a temperature and humidity of the compressed air so as to prevent aggregation of the powder.

According to still another aspect of the present invention, in an electrostatic powder coating apparatus in which a fluid-bed type hopper is vertically partitioned by a porous member to define therein an upper fluidizing container and a lower air chamber, and compressed air supplied to the air chamber flows into the fluidizing container through the porous member for fluidizing the powder, stirring blades are provided in the fluidizing container.

According to still another aspect of the present invention, in an electrostatic powder coating apparatus in which a fluid-bed type hopper is vertically partitioned by a porous member to define therein an upper fluidizing container and a lower air chamber, and compressed air supplied to the air chamber flows into the fluidizing container through the porous member for fluidizing the powder, the apparatus includes temperature/humidity control means for adjusting a temperature and humidity of the compressed air so as to prevent aggregation of the powder, and stirring blades are provided in the fluidizing container.

According to still another aspect of the present invention, in an electrostatic powder coating apparatus in which a fluid-bed type hopper is vertically partitioned by a porous member to define therein an upper fluidizing container and a lower air chamber, compressed air supplied to the air chamber flows into the fluidizing container through the porous member for fluidizing the powder, and the powder is supplied from the fluid-bed type hopper to a spray gun through an injector and a powder supply tube, stirring blades for promoting fluidization of the powder are provided in the fluidizing container, and the apparatus includes temperature/humidity control means for controlling a temperature and humidity of the compressed air so as to prevent aggregation of the powder.

According to still another aspect of the present invention, in an electrostatic powder coating method by which a fluid-bed type hopper is vertically partitioned by a porous member to define therein an upper fluidizing container and a lower air chamber, compressed air supplied to the air chamber flows into the fluidizing container through the porous member for fluidizing the powder, and the powder is sprayed from a spray gun toward a product to be coated, a temperature and humidity of the compressed air is adjusted by temperature/humidity control means so as to prevent aggregation of the powder, and stirring blades are rotated in the fluidizing container to fluidize the powder.

Incidentally, the electrostatic repulsion preventing means in this application is obtained by adapting the electrostatic repulsion preventing means disclosed in Japanese Patent Application Laid-Open No. 6-114297.

DESCRIPTION OF THE PREFERRED EMBODIMENTS

Figure 1:
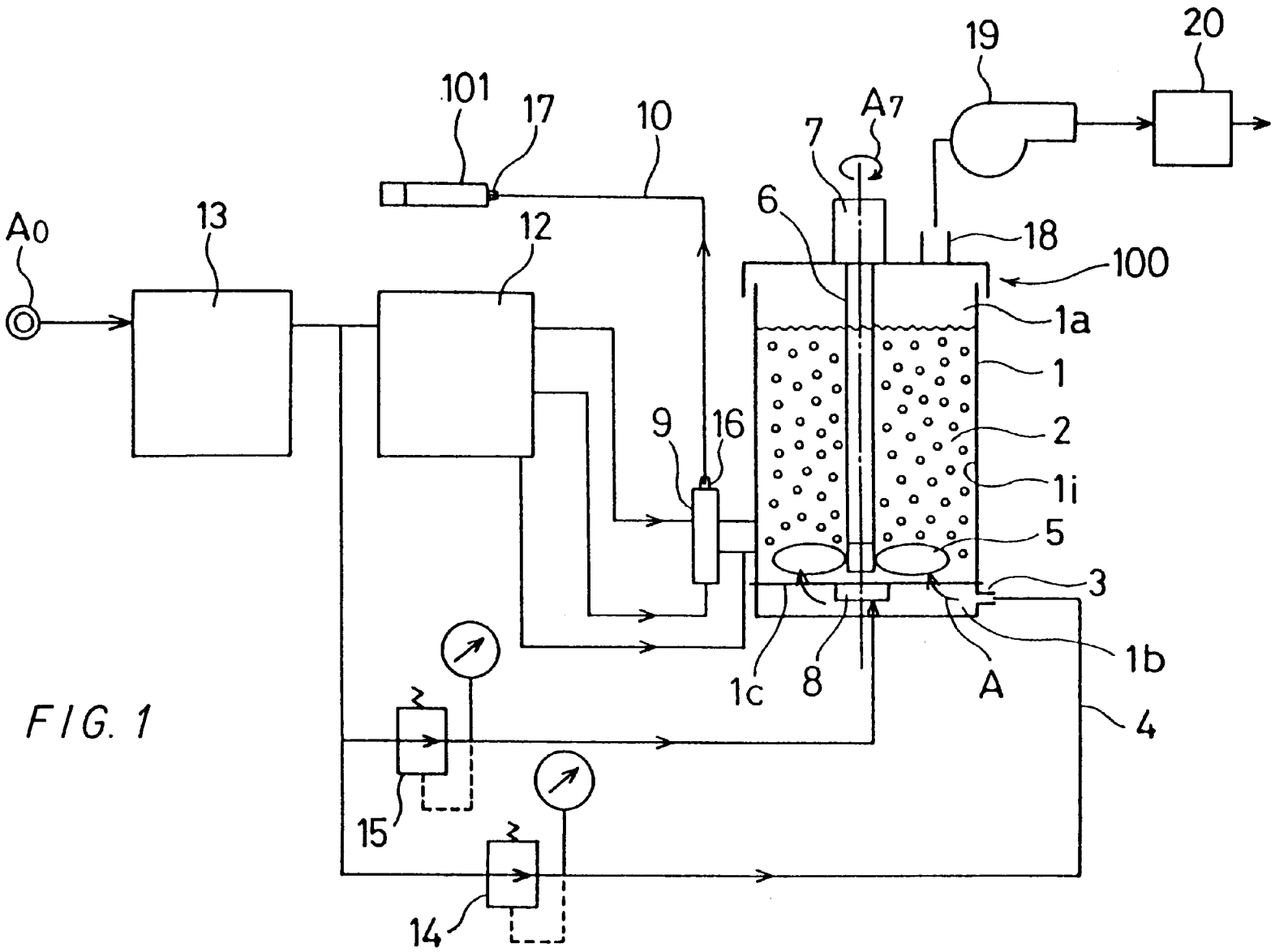
FIG. 1 is a diagram showing a first embodiment of the present invention.
Figure 2:
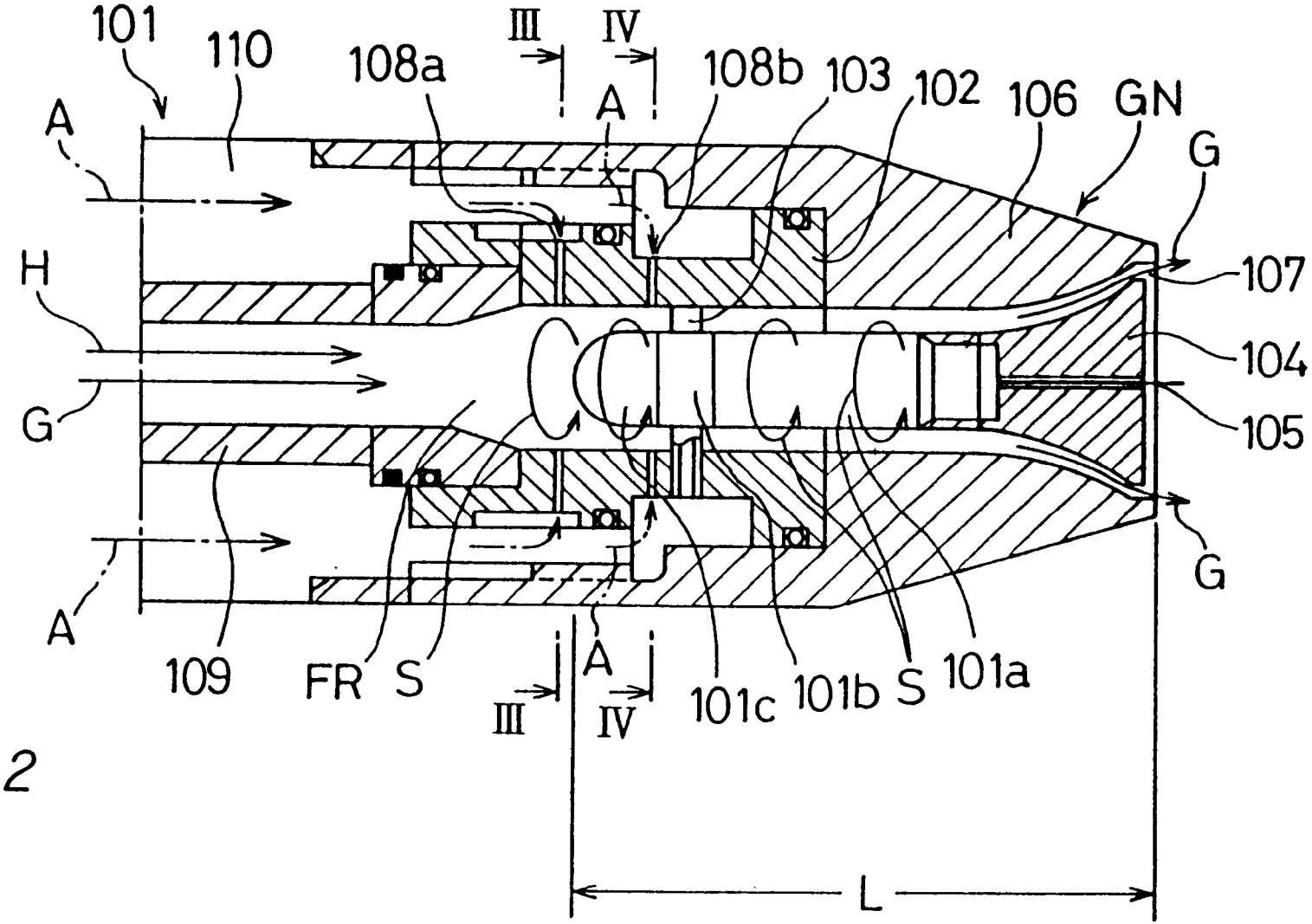
FIG. 2 is an enlarged sectional view of a nozzle tip of a spray gun in the present invention.

A first embodiment of the present invention will be described with reference to FIGS. 1 to 5. As shown in FIG. 1, an electrostatic powder coating apparatus includes a powder supply unit 100 and a spray gull 101.

A description will first be made of the powder supply unit 100.

The powder supply unit 100 mainly comprises, as shown in FIG. 1, a fluid-bed type hopper 1 containing fine particle powder 2 having an average particle size not greater than 25 μm, preferably in the range of 5 to 20 μm, an injector 9 for sucking the powder 2, which is fluidized by fluidizing means described later in detail, from the fluid-bed type, hopper 1, and pressure-feeding it to the spray gun 101 through a powder supply tube 10, a coating control panel 12 for adjusting the amount of air supplied to the injector 9 to thereby control the amount of powder sucked, a temperature/humidity controller 13 for adjusting the temperature and humidity of compressed air supplied to the coating control panel 12 and the fluidizing means, an exhaust fan 19 for exhausting extra air through an exhaust port 18 of the powder container 1, and a filter 20 for filtering the exhausted air.

In the powder supply unit 100, a compressed air source Ao necessary for supplying the powder supplies compressed air A, that is controlled by the temperature/humidity controller 13 to have a relatively low temperature and low humidity, i.e., a temperature not higher than 25° C. and humidity not higher than 50%, to the coating control panel 12 and other equipment as fluidizing air and air vibrator driving air.

The fluid-bed type hopper 1 is partitioned by a porous resin plate or a canvas sheet 1*c* into a fluidizing container 1*a* and an air chamber 1*b*. A fluidizing air supply tube 4 is connected to a fluidizing air supply port 3 provided in a side of the air chamber 1*b*. A flow rate of the fluidizing air controlled by the temperature/humidity controller 13 to have a relatively low temperature and low humidity can be adjusted by a pressure reducing valve 14.

Inside the fluidizing container 1*a* of the fluid-bed type hopper 1, there are disposed stirring blades 5 mounted to a stirring blade support rod 6. The stirring blades 5 and the stirring blade support rod 6 are rotated by a stirring blade drive motor 7 at a low speed in the direction of arrow A7 so as to stir the powder 2 in the fluid-bed type hopper 1.

Vibrating means, e.g., an air vibrator 8, is mounted to the underside of the canvas sheet 1*c*. A flow rate of air supplied to the air vibrator 8 is adjusted by a pressure reducing valve 15 for control of vibration force produced by the air vibrator 8. The vibrating means is not limited to the air vibrator, but may be of, e.g., an electric vibrator.

Powder adhesion preventing means, e.g., a layer of fluorine-contained resin, is formed on each of powder contact surfaces, i.e., each of the portions of various equipment and components which are brought into contact with powder, such as an inner surface 1*i* of the powder container 1, outer surfaces of the stirring blades 5 and the stirring blade support rod 6, an inner surface of the injector 9, inner surfaces of joints 16, 17, and an inner surface of the powder supply tube 10.

The powder adhesion preventing means is not limited to surface treatment using a fluorine-contained resin, but may be of a composite plated coating in which fine particles of a fluorine-contained resin are uniformly dispersed in an eutectic alloy, or a conductive resin having conductivity not higher than $10^{10}$ Ωcm.

The powder adhesion preventing means for the powder container 1, the stirring blades 5, the injector 9 and the joints 16, 17 may be effected by the surface treatment using a fluorine-contained resin, or a composite plated coating in which fine particles of a fluorine-contained resin are uniformly dispersed in an eutectic alloy, whereas the powder adhesion preventing means for the powder supply tube 10 may be effected by a conductive resin.

With the provision of the powder adhesion preventing means as explained above, adhesion of the powder to undesired portions can be prevented. As a result, the powder is prevented from adhering to the inner surfaces of the fluid-bed type hopper and the spray gun, for example, which otherwise causes aggregation of the powder.

To increase the stirring effect, stirring aid balls, e.g., balls of ceramic such as alumina having a diameter of 3 to 10 mm, may be disposed in appropriate number on the bottom surface of the fluidizing container so that the balls are also stirred with the powder as the stirring blades are rotated. While the diameter, the number, etc. of the stirring aid balls are appropriately selected case by case, a number 50 to 100 of ceramic balls are employed, by way of example, for the fluidizing container with capacity of 10 to 600 liters.

The balls are not limited in material to ceramic such as alumina, but may be formed of any other desired material which does not adversely affect the powder, e.g., of glass beads.

Operation of the powder coating apparatus of this embodiment will now be described. The compressed air A supplied from the compressed air source Ao under high pressure of 0.5 to 3.0 kgf/cm$^2$, for example, is adjusted by the temperature/humidity controller 13 to have a relatively low temperature and low humidity, e.g., a temperature in the range of 5 to 25° C. and humidity not higher than 50%. After that, the air A is pressure-fed through the fluidizing air supply tube 4 midway which a flow rate of the air is controlled by the pressure reducing valve 14, and then to the air chamber 1*b* from the fluidizing air supply port 3. In the above process, the temperature/humidity controller 13 controls the temperature and humidity of the compressed air so that the powder will not aggregate into lumps. As a result, the powder can be prevented from aggregating together and changing properties thereof.

The compressed air A fed to the air chamber 1*b* flows into the fluidizing container 1*a* through the canvas sheet 1*c*, moves toward the exhaust port 18 while fluidizing the fine particle powder 2, and is then exhausted to the outside of the apparatus through the exhaust fan 19 and the filter 20.

The compressed air A is also supplied to the air vibrator 8 through the pressure reducing valve 15. The air vibrator 8 vibrates the canvas sheet 1*c* for vibrating the fine particle powder 2 in the fluidizing container 1*a*. While the number of vibrations of the air vibrator 8 is appropriately selected case by case, it is set to, for example, 2,000 to 30,000 rpm.

Figure 5:
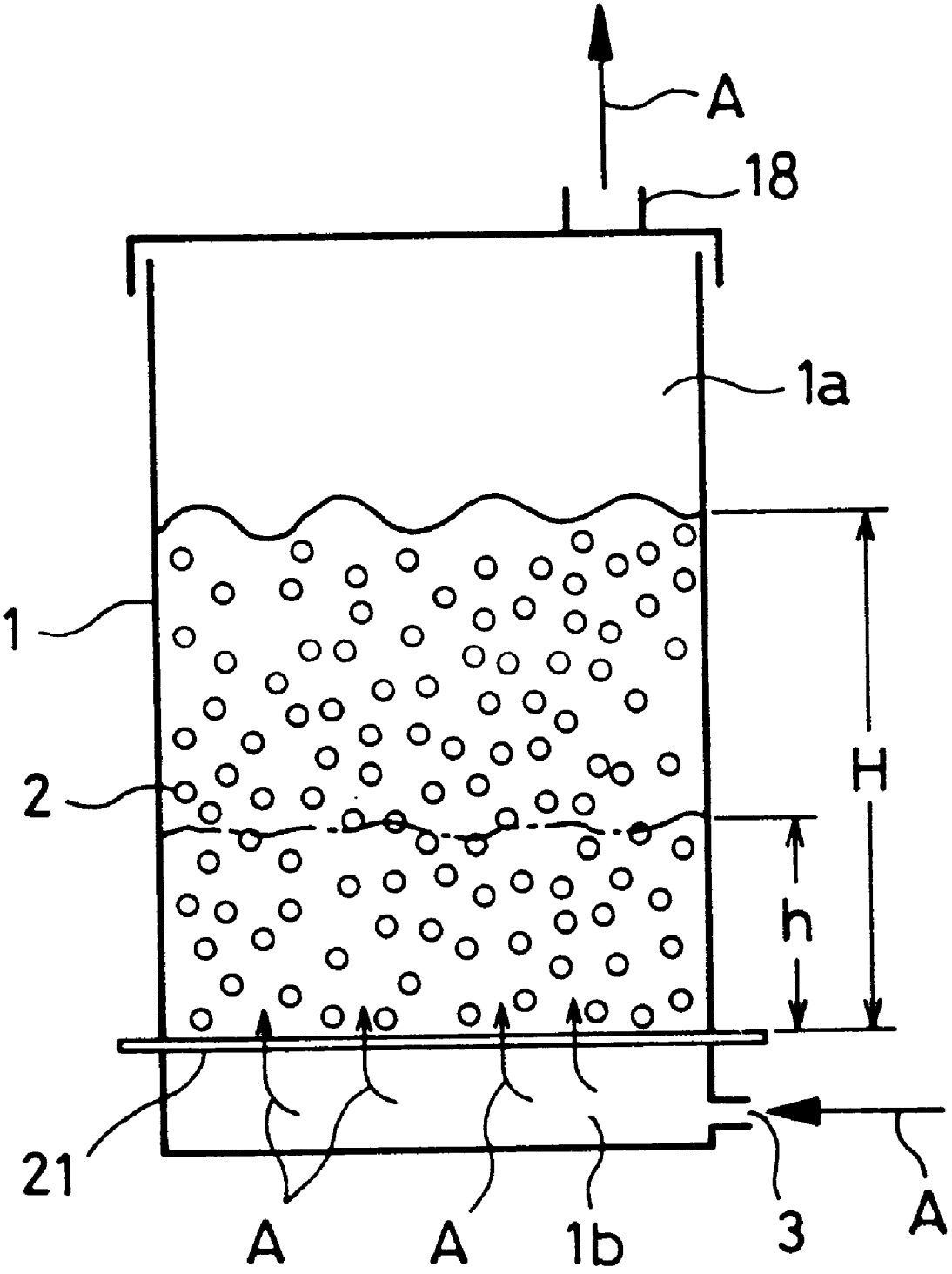
FIG. 5 is a schematic enlarged view of a powder supply unit shown in FIG. 1.

When the motor 7 is driven to rotate the stirring blades 5 within the fluidizing container 1*a* in the direction of arrow A7, the fine particle powder 2 is stirred to be evenly mixed with air, resulting in the condition shown in FIG. 5. While the rotating speed of the stirring blades 5 is appropriately selected case by case, it is set to, for example, 10 to 100 rpm. Here, the height H of a fluidized powder level in the fluidizing container 1*a* is 1.2 to 2.5 times the height h of a powder level in the non-fluidized state.

The sufficiently fluidized fine particle powder 2 reaches the spray gun 101 through the injector 9, the joint 16, the powder supply tube 10 and the joint 17, and is then sprayed from the spray gun 101 toward a product to be coated.

Next, the spray gun 101 will be described in comparison with prior one.

Figure 11:
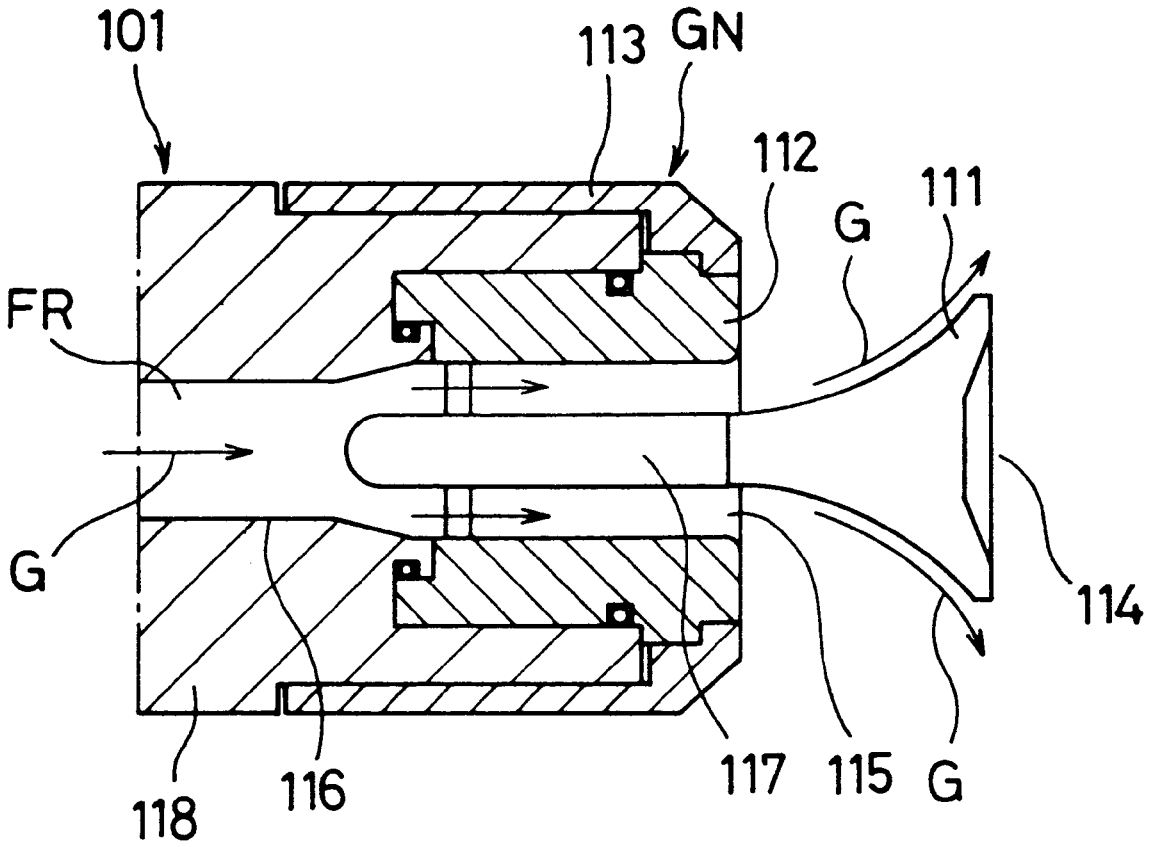
FIG. 11 (PRIOR ART)
FIG. 11 is a sectional view showing a spray gun of prior art.

A typical diffuser type gun nozzle has a conical shape as shown in FIG. 11 as prior art. A conical diffuser 111 is axially disposed in a flow passage FR of powder. When powder particles G are sprayed from a nozzle tip GN of the spray gun 101, they impinge against the diffuser 111 to be directed radially outwardly of the powder flow passage FR for changing into a cylindrical spray pattern. Additionally, denoted by 112 is an inner cylinder, 113 is an outer cylinder, 114 is a corona discharge electrode, 115 is a nozzle opening, 116 is a powder introducing tube, 117 is an electrode cover, and 118 is a gun body.

The role of the diffuser 111 is to soften the spray pattern for an improvement in the transfer efficiency. Accordingly, for the fine particle powder used in the present invention, high transfer efficiency can also be achieved by using the diffuser type gun nozzle shown in FIG. 11 and spraying the powder under proper coating conditions. However, the fine particle powder once aggregated is hard to pulverize and a good appearance of the coating film cannot be obtained.

In view of the foregoing, by constructing the spray gun 101 as shown in FIGS. 1 to 4, the fine particle powder aggregated during the processes of fluidizing and feeding can be pulverized in the final spray process, i.e., in the nozzle tip GN, and can be sprayed in the dispersed condition toward the product to be coated.

A nozzle tip connected to a spray gun body 110 comprises, as shown in FIGS. 1 to 4, electrode covers 101*a*, 101*b*, 101*c* including protecting resistances provided therein for safety, an inner cylinder 102 to which the electrode cover 101*b* is fixed by an electrode support member 103, a diffuser 104 doubling as an electrode end cover, a discharge electrode 105 exposed 1 to 2 mm outwardly of the electrode end cover 104, and an outer cylinder 106.

The electrode covers 101*a*, 101*b* and the diffuser 104 are inserted to the powder flow passage FR in the nozzle tip GN, and the fore end of the diffuser 104 is positioned inside the nozzle opening 107. In the zone L where the above members 101*a*, 101*b* and 104 are inserted, the powder flow passage is narrowed.

Figure 3:
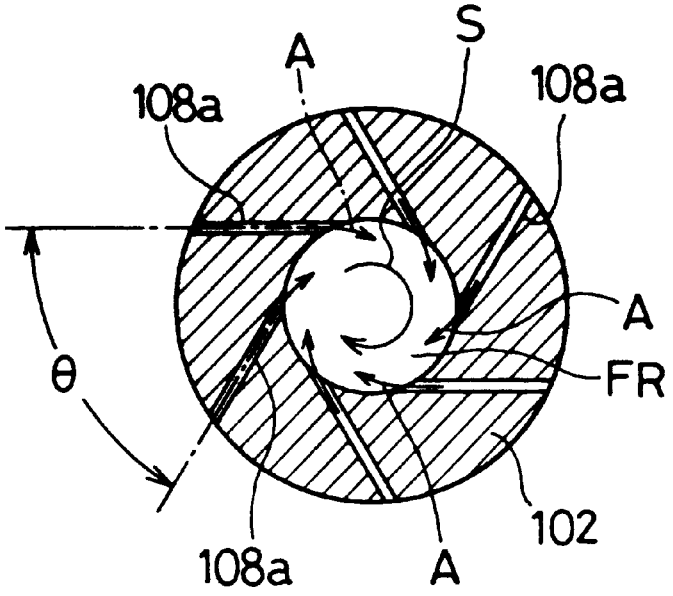
FIG. 3 is a sectional view taken along line III—III in FIG. 2.
Figure 4:
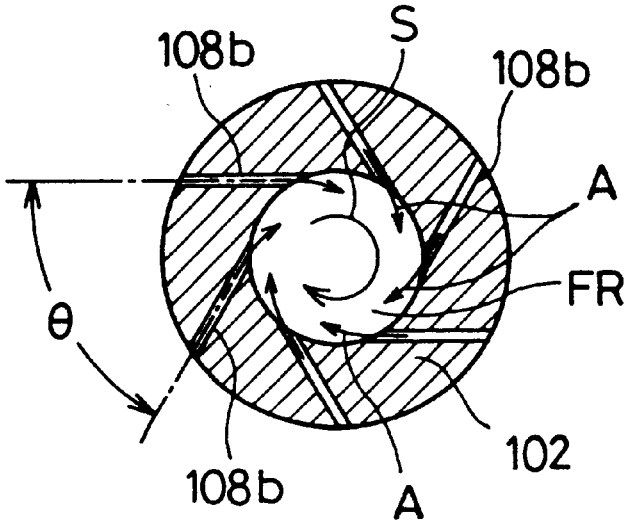
FIG. 4 is a sectional view taken along line IV—IV in FIG. 2.

In the zone L, a cross-sectional area of the powder flow passage FR vertical to the direction of feeding of the powder is designed to be 10 to 50% smaller than a cross-sectional area of a powder introducing tube 109 in the radial direction thereof, so that the carrying speed of the powder is increased in the zone L. Further, as shown in FIGS. 3 and 4, vortex air introduction ports 108*a*, 108*b* are provided in a peripheral wall of the inner cylinder 102 to extend in the tangential direction of the powder flow passage FR. While an intersect angle θ between respective extensions of the introduction ports 108*a*, 108*b* is appropriately selected case by case, it is set to, for example, 60 degrees.

During the coating operation, the compressed air A is supplied to the vortex air introduction ports 108*a*, 108*b* in communication with the powder introducing tube 109 for cleaning the electrode cover 101*c* and the electrode support member 103, respectively.

In addition, with the vortex air A being thus introduced, the flow of powder conveying air turns to a flow of vortex air S about the direction of feeding of the powder, i.e., an axis of the powder flow passage FR, and is accelerated due to the reduced cross-sectional area of the open passage in the zone L. Then, the flow of powder conveying air impinges against the diffuser 104 gradually spreading in a conical shape, whereupon the aggregated fine particle powder is pulverized and dispersed. The pulverized fine particle powder G is sprayed toward the electrically grounded product to be coated while being kept evenly dispersed, thereby forming a uniform coating film on the product surface.

Thus, since means for pulverizing and dispersing the aggregated powder is provided in the nozzle tip of the spray gun, the powder even in the form of fine particle powder is surely sprayed from the nozzle end in the pulverized and dispersed condition. It is therefore possible to form a highly uniform and smooth coating film on the product surface to be coated.

Incidentally, since a cross-sectional area of the opening 107 at the nozzle end is 10 to 50% smaller than that of the opening 115 in the prior art nozzle, the initial speed of the sprayed powder is increased 1.1 to 2 times that in the prior art nozzle if the powder is fed at the same flow rate of conveying air. With the flow rate of conveying air being the same, however, a reduction in the transfer efficiency due to the powder being blown away by the conveying air can be prevented by setting a proper distance between the gun and the product to be coated so that the sprayed conveying air is sufficiently decelerated.

Figure 6:
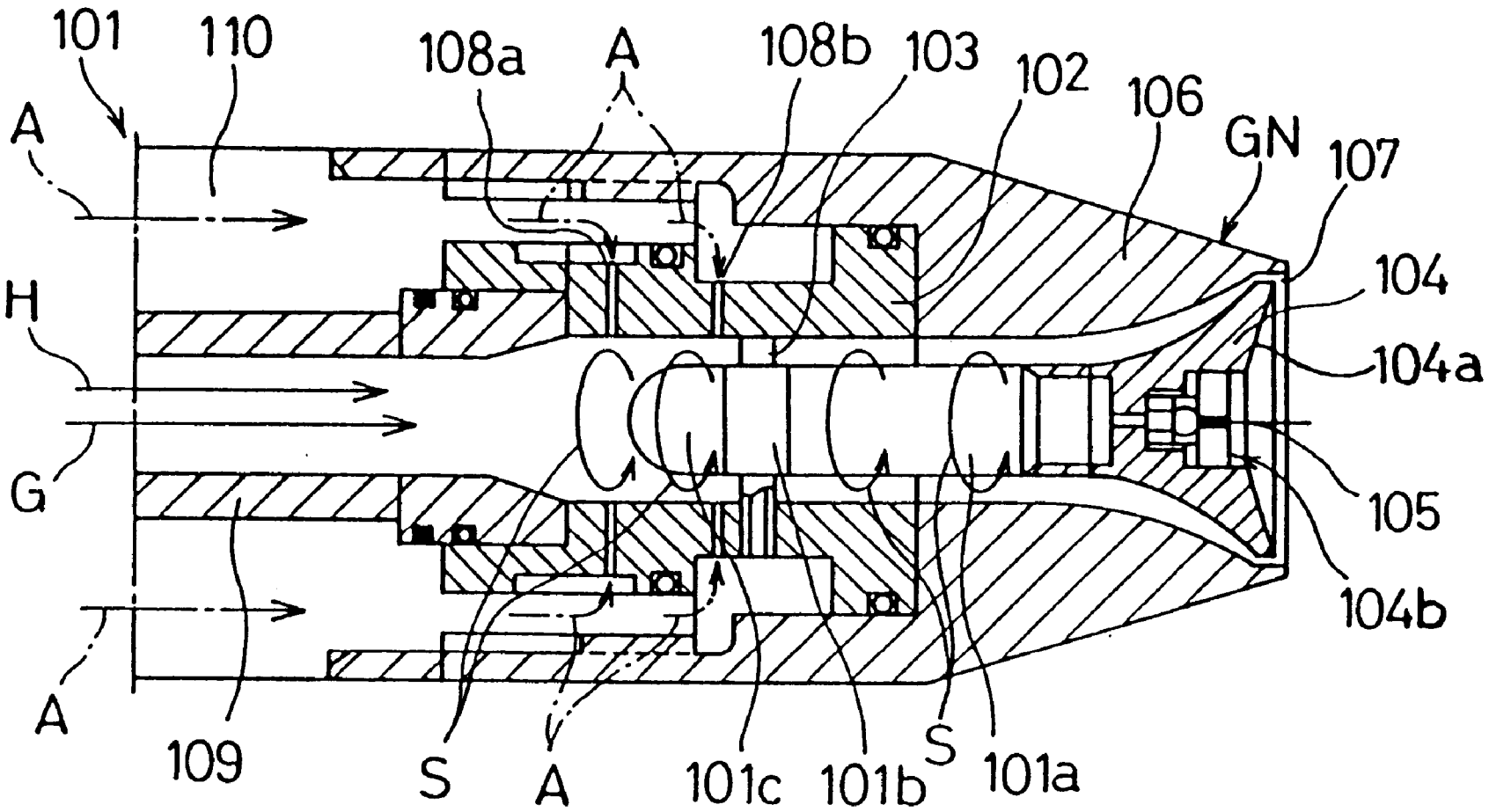
FIG. 6 is a sectional view showing a second embodiment of the present invention.
Figure 7:
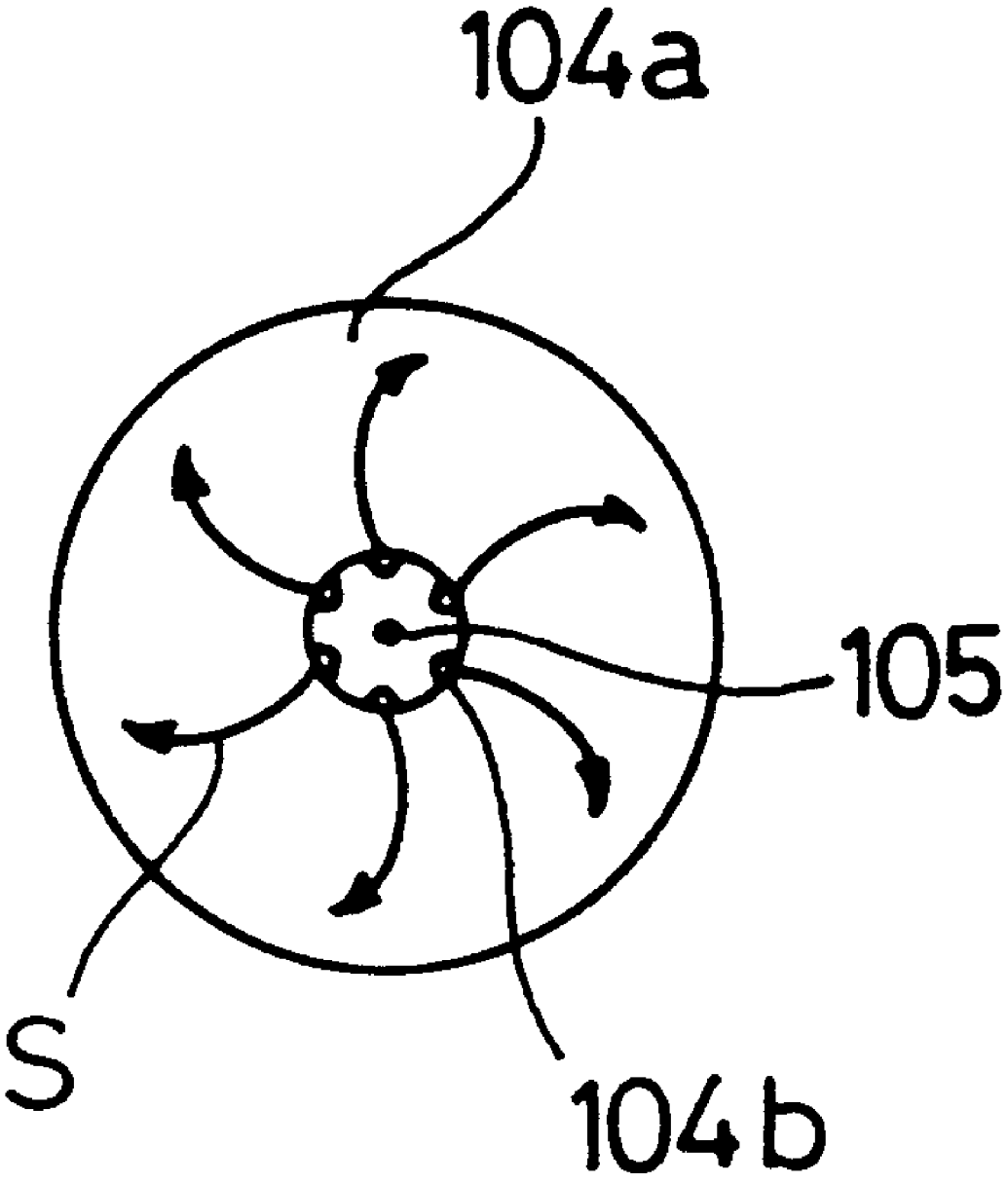
FIG. 7 is a side view showing the second embodiment.

FIGS. 6 and 7 show a second embodiment of the present invention. This second embodiment is different from the first embodiment in that this embodiment has a function of preventing the powder from depositing on a diffuser outer surface 104*a* in the nozzle tip GN. Specifically, as shown in FIG. 7 which is a side view of the diffuser outer surface 104*a* shown in FIG. 6, the diffuser outer surface 104*a* is entirely rinsed by the vortex flow (air) S so that it is cleaned and held in the clean state at all times during the coating operation. The vortex flow (air) S is sprayed through outlets 104*b*. The rinsing air to clean the entire diffuser outer surface 104*a* is not limited to the vortex air, but may flow in any such a suitable direction as to be able to clean the entire diffuser outer surface 104*a*.

Figure 8:
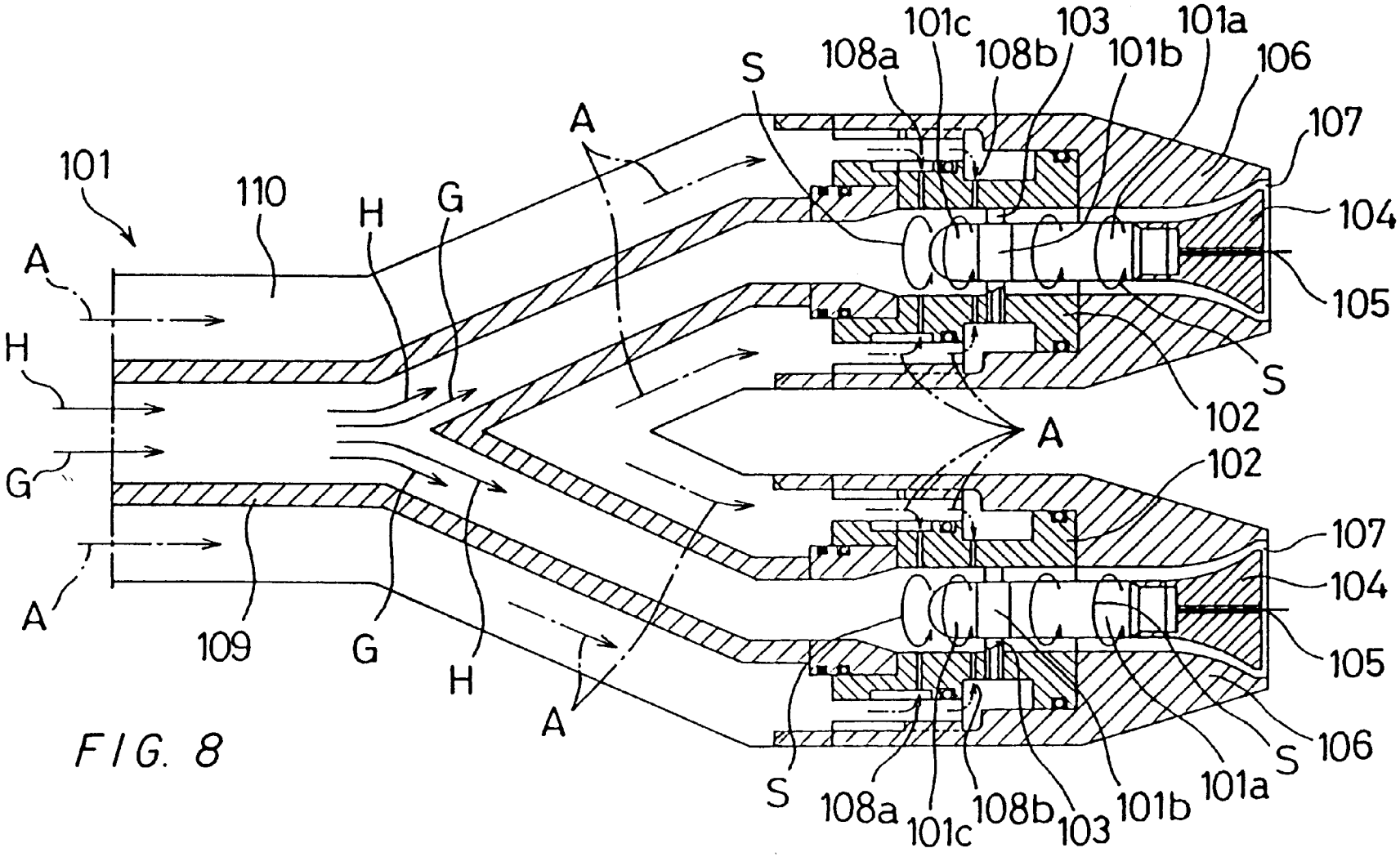
FIG. 8 is a sectional view showing a third embodiment of the present invention, the view corresponding to FIG. 2.

FIG. 8 shows a third embodiment of the present invention. This third embodiment is different from the first embodiment in that the nozzle tip of the spray gun 101 is branched into two parts. In other words, by branching the nozzle tip of the spray gun is into a plurality of parts, the total amount of powder sprayed per gun can be held at the same value although the amount of powder sprayed per nozzle is reduced. Therefore, the need of adding another fuel supply system is avoided and an increase in the equipment cost can be prevented.

While the nozzle tip is branched into two parts in the embodiment shown in FIG. 8, the number of branched nozzles may be increased to three or more. Alternatively, several nozzle may be each constructed as with the second embodiment.

Figure 9:
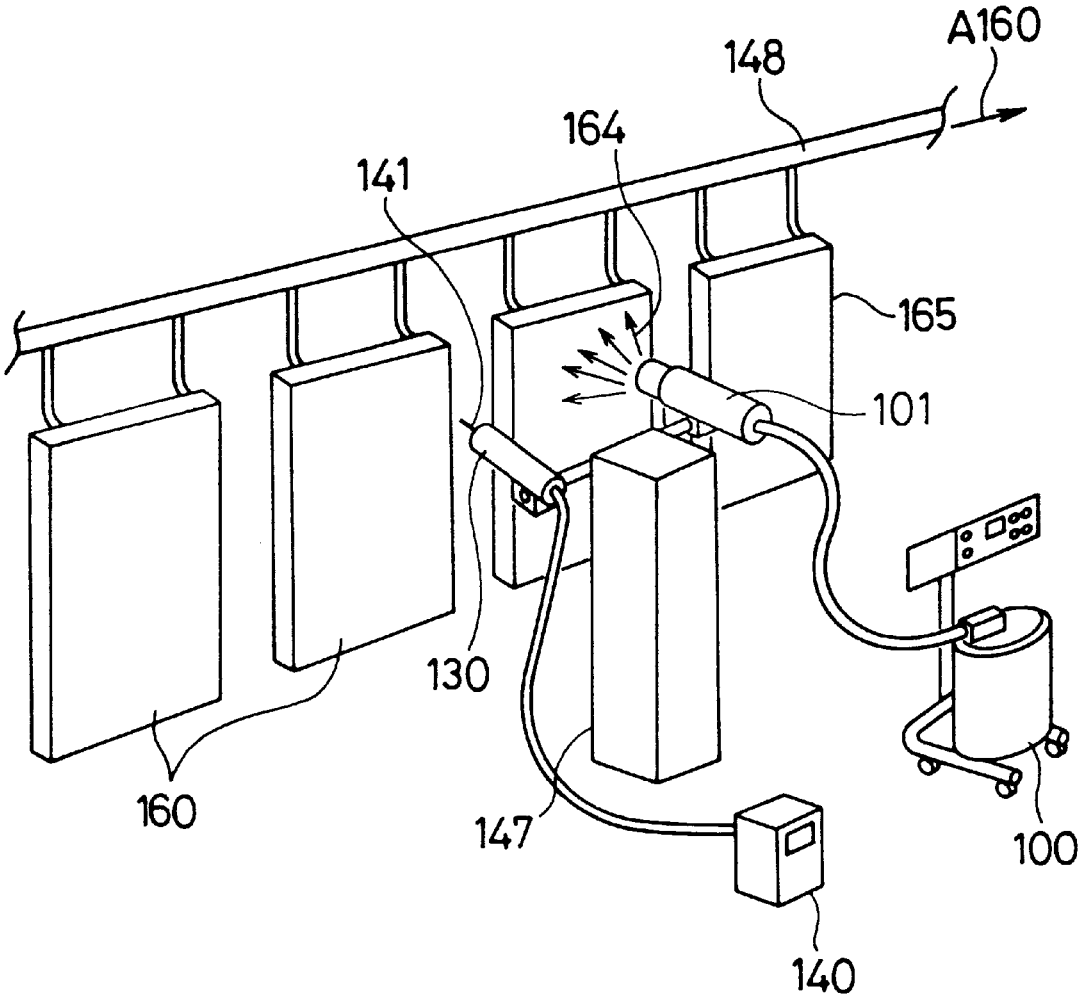
FIG. 9 is a perspective view showing a fourth embodiment of the present invention.
Figure 10:
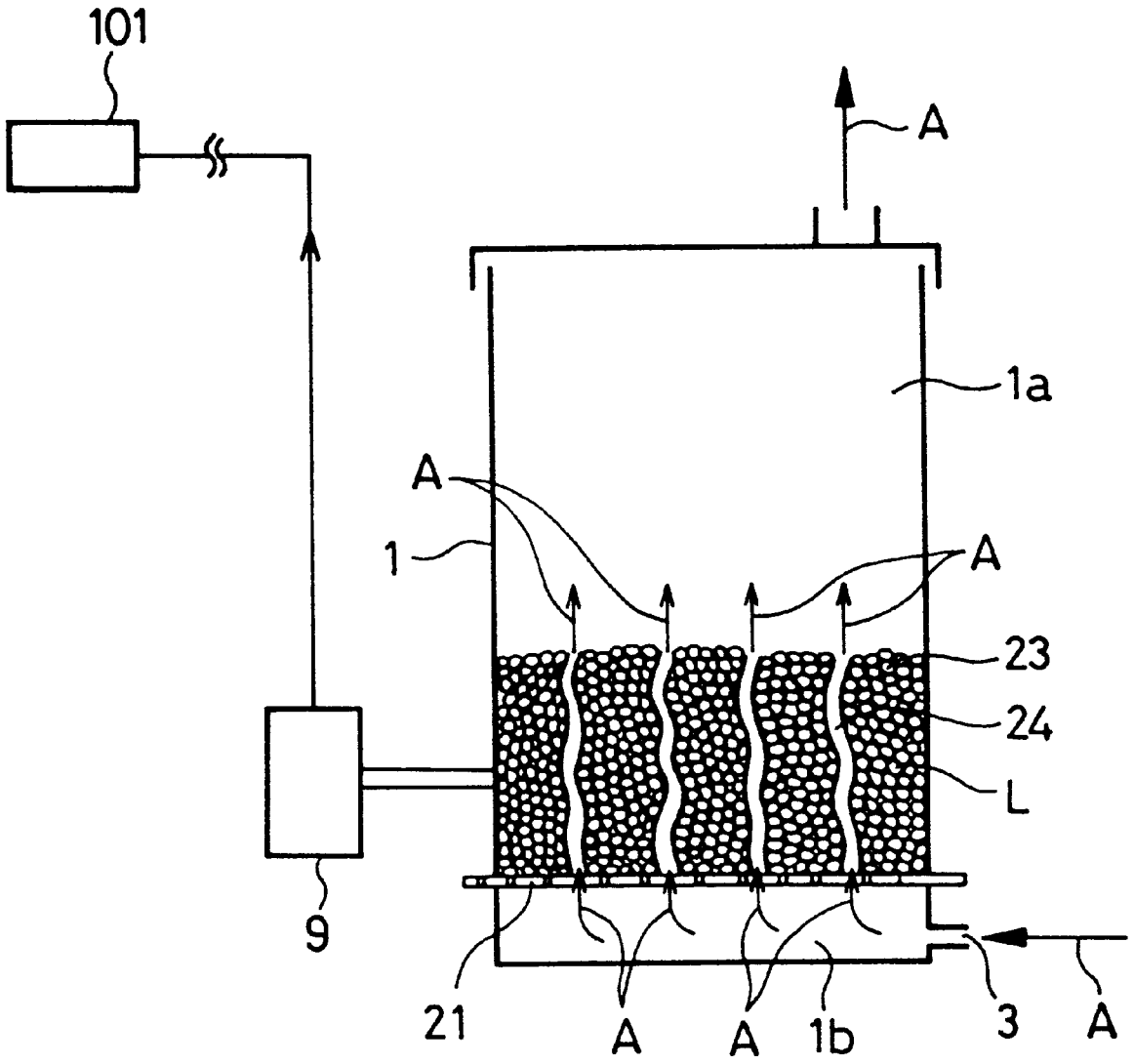
FIG. 10 (PRIOR ART)
FIG. 10 is a sectional view showing a powder supply unit of prior art.

A fourth embodiment of the present invention will now be described with reference to FIG. 9. This fourth embodiment is different from the first embodiment in that electrostatic repulsion preventing means is provided upstream of the spray gun in the direction of conveyance of products to be coated.

A corona discharger 130 is used as the electrostatic repulsion preventing means. The corona discharger 130 is disposed upstream of the spray gun 101, and comprises a high-voltage generator 140 and a corona pin (corona discharge electrode) 141. The spray gun 101 and the corona pin 141 are each reciprocally movable in the vertical direction by a reciprocator 147.

An overhead conveyor 148 operates to convey products 160 to be coated in the direction of arrow A160 and is electrically grounded.

A predetermined voltage, e.g., a negative voltage of 80 kV, is applied to the spray gun 101 and a voltage having the opposite polarity to that applied to the spray gun 101, i.e., a positive voltage, is applied to the corona pin 141 of the corona discharger 130.

Then, the overhead conveyor 148 is driven to convey the products 160 to be coated in the direction of arrow A160, the products 160 being suspended from the overhead conveyor 148 through hangers with intervals therebetween. Each of the products 160 to be coated has an under coat formed on its surface.

When the product 160 to be coated is conveyed to a position in front of the corona pin 141, the product surface is charged to have a positive potential with corona discharge and its surface potential is raised. While the surface potential at this time is appropriately selected case by case, it is preferably set to fall in the range of 200 V to 3 kV. The surface potential can be controlled by changing the applied voltage, the discharge distance and the discharge time.

Then, the product 160 is conveyed to a position in front of the spray gun 101 where powder 164 charged with negative polarity is electrostatically deposited on the product surface to form a smooth coating film 165. At this time, since the surface potential with positive polarity, i.e., plus ions, and the applied voltage of the spray gun 101, i.e., minus ions, are canceled each other and neutralized, the coated surface will not become so high in potential as to cause back ionization.

Of course, the under coat on the product surface may be of a single layer or a multilayer.

Thus, the provision of the electrostatic repulsion preventing means, when the powder is sprayed from the spray gun to form a film on the product to be coated, the charged powder is efficiently coated on the product surface while being attracted toward there.

EXPERIMENTAL EXAMPLE

From experiments below conducted for comparison between the present invention and the prior art, the results listed in the following Table 1 were obtained. In Table 1, A represents the spray gun of the first embodiment (see FIG. 2), B represents the spray gun of the second embodiment (see FIG. 6), and C represents the spray gun of prior art (see FIG. 11).

Steel plates had a size of 300×450 mm, and coated plates had a size of 300×450 mm with a cationic electrodeposited coating film and polyester primer surfacer formed as laminated layers on the surface. The applied voltage for charging with opposite polarity was +20 kV, the applied voltage of the spray gun was −80 kV, the distance between the spray gun and the product to be coated was 200 mm, the powder feed rate was 100 g/min., and the powder was A-50 clear powder manufactured by Nippon Paint Co., Ltd. and had an average particle size D50%=10 μm. Spits and electrostatic repulsion were visually observed and evaluated. The transfer efficiency η (%) was determined from the equation below. The equation is to calculate the transfer efficiency based on a ratio of the amount P1 of sprayed powder to the amount Pa of powder deposited on the product to be coated. In the equation, T represents time required to coat the product.

$$\eta=100(Pa/P_1)/T=100PA/(P_1T)$$

TABLE 1

| | | | | Evaluation items | | | |
|---|---|---|---|---|---|---|---|
| | | | | | Electrostatic repulsion | | |
| I | II | III | IV | Spits | 50μm thick | 100μm thick | V |
| 1 | A | steel plate | none | none | none | none | 80.3 |
| 2 | B | steel plate | none | none | none | none | 78.0 |
| 3 | B | coated plate | none | none | none | found | 69.1 |
| 4 | B | coated plate | +20kV | none | none | none | 74.0 |
| 5 | C | steel plate | none | found | none | none | 77.3 |
| 6 | C | coated plate | none | found | none | found | 68.2 |

(I) Measurement No.
(II) Gun nozzle
(III) Product to be coated
(IV) Charging with opposite polarity
(V) Deposition efficiency (%)

In the measurements (Nos. 1 to 4) using the spray gun nozzles (A, B) of the present invention, no spits are caused. In the measurement No. 3 (the product to be coated having an under coat formed thereon), however, the transfer efficiency is lowered and the electrostatic repulsion is caused when the film thickness reaches 100 μm.

In the measurement No. 4, just prior to the coating, the product surface was previously charged with opposite polarity to the gun (applied voltage: +20 kV), as the electrostatic repulsion preventing means, so that the product to be coated had a surface potential in the range of +100 V to 3 kV. As a result, the transfer efficiency was increased about 5 points and no electrostatic repulsion was found even at the film thickness of 100 μm.

Thus, even for the product to be coated having an under coat formed thereon, a coating film which causes neither spits nor electrostatic repulsion and has a good appearance can be formed with high transfer efficiency by using the spray gun nozzle B (second embodiment) of the present invention and, at the same time, effecting the electrostatic repulsion preventing means of the fourth embodiment.

The present invention can be carried out in other various forms than illustrated above without departing from the spirit and the principal features of the invention. Therefore, the foregoing embodiments are given by way of example only in all respects and should not be construed in a limiting sense.

We claim:

1. An electrostatic powder coating apparatus comprising:

a spray gun;

a powder supply unit;

wherein said electrostatic powder coating apparatus is adapted to form a coating film by spraying electrostatically charged powder toward a surface of an electrically grounded product to be coated;

wherein a nozzle tip of said spray gun includes powder adhesion preventing means, said powder adhesion preventing means including compressed air for rinsing an outer surface of said nozzle tip; and wherein said powder supply unit comprises a fluid-bed type hopper vertically partitioned by a porous member to define therein an upper fluidizing container and a lower air chamber, and includes temperature/humidity control means for adjusting a temperature and humidity of compressed air supplied to said air chamber and means for stirring said powder in said fluidizing container.

2. The electrostatic powder coating apparatus according to claim 1, wherein said nozzle tip of said spray gun is branched into multiple parts.

3. The electrostatic powder coating apparatus according to claim 2, further comprising corona discharge means to which is applied a voltage with opposite polarity to a voltage applied to said spray gun, said corona discharge means being disposed upstream of said spray gun in a direction of conveyance of said product to be coated.

4. The electrostatic powder coating apparatus according to claim 1, further comprising corona discharge means, wherein a voltage is applied to said corona discharge means, said voltage having an opposite polarity to a voltage applied to said spray gun in a direction of conveyance of said product to be coated.

5. The electrostatic powder coating apparatus according to claim 1, wherein said powder adhesion preventing means is compressed air supplied to said powder flow passage inside of said nozzle tip for cleaning an inner surface of said nozzle tip and wherein said nozzle tip of said spray gun is branched into multiple parts.

6. The electrostatic powder coating apparatus according to claim 1, wherein said powder adhesion preventing means is a flow of a vortex air supplied to said powder flow passage inside of said nozzle tip to effect not only a function of cleaning an inner surface of said nozzle tip to remove adhered powder, but also a function of said means for pulverizing and dispersing said aggregated powder and wherein said nozzle tip of said spray gun is branched into multiple parts.

7. The electrostatic powder coating apparatus according to claim 1, wherein said powder adhesion preventing means is compressed air supplied to said powder flow passage inside of said nozzle tip for cleaning an inner surface of said nozzle tip and further comprising corona discharge means to which is applied a voltage with opposite polarity to a voltage applied to said spray gun, said corona discharge means being disposed upstream of said spray gun in a direction of conveyance of said product to be coated.

8. The electrostatic powder coating apparatus according to claim 1, wherein said powder adhesion preventing means is a flow of a vortex air supplied to said powder flow passage inside of said nozzle tip to effect not only a function of cleaning an inner surface of said nozzle tip to removed adhered powder, but also a function of said means for pulverizing and dispersing said aggregated powder and further comprising corona discharge means to which is applied a voltage with opposite polarity to a voltage applied to said spray gun, said corona discharge means being disposed upstream of said spray gun in a direction of conveyance of said product to be coated.

9. An electrostatic powder coating method comprising the steps of:

forming an undercoat on a product to be coated;

repeating, at least once, said forming of said undercoat on said product to be coated so as to form a plurality of layers of said undercoat;

subjecting said product to be coated, which has said plurality of layers of undercoat formed thereon, to electrostatic repulsion preventing treatment by using corona discharge means;

swirling powder in a powder flow in a powder flow passage inside a nozzle tip of a spray gun; and spraying said powder, which is supplied from a powder supply unit, from said nozzle tip of said spray gun toward an electrically grounded product to be coated.

10. The electrostatic powder coating method according to claim 9, wherein said step of subjecting said product to be coated to said electrostatic repulsion preventing treatment includes exposing said product to be coated to an electric field with opposite polarity to said spray gun for charging a surface of said under coat beforehand.

11. An electrostatic powder coating apparatus comprising:

a spray gun;

a powder supply unit;

wherein said electrostatic powder coating apparatus is adapted to form a coating film by spraying electrostatically charged powder toward a surface of an electrically grounded product to be coated;

wherein a nozzle tip of said spray gun includes means for pulverizing and dispersing an aggregated powder and powder adhesion preventing means, said powder adhesion preventing means including compressed air for rinsing an outer surface of said nozzle tip; and wherein said powder supply unit comprises a fluid-bed type hopper vertically partitioned by a porous member to define therein an upper fluidizing container and a lower air chamber, and includes temperature/humidity control means for adjusting a temperature and humidity of compressed air supplied to said air chamber and means for stirring said powder in said fluidizing container.

12. The electrostatic powder coating apparatus according to claim 11, wherein said nozzle tip of said spray gun is branched into multiple parts.

13. The electrostatic powder coating apparatus according to claim 12, wherein further comprising corona discharge means to which is applied a voltage with opposite polarity to a voltage applied to said spray gun, said corona discharge means being disposed upstream of said spray gun in a direction of conveyance of said product to be coated.

14. The electrostatic powder coating apparatus according to claim 11, further comprising corona discharge means to which is applied a voltage with opposite polarity to a voltage applied to said spray gun in a direction of conveyance of said product to be coated.

15. The electrostatic powder coating apparatus according to claim 11, wherein said means for pulverizing and dispersing comprises an electrode cover disposed in a powder flow passage in said nozzle tip and a diffuser, said diffuser being continuously connected to said electrode cover and said diffuser having a fore end thereof positioned inside of a nozzle opening, and wherein said nozzle tip of said spray gun is branched into multiple parts.

16. The electrostatic powder coating apparatus according to claim 11, wherein said means for pulverizing and dispersing comprises a powder flow passage defined between an inner surface of said nozzle tip and an outer surface of said diffuser, said powder flow passage gradually narrowing toward a nozzle opening, and vortex air introduction ports through which vortex air is supplied to a powder flow passing through said powder flow passage, and wherein said nozzle tip of said spray gun is branched into multiple parts.

17. The electrostatic powder coating apparatus according to claim 11, wherein said powder adhesion preventing means is compressed air supplied to said powder flow passage inside of said nozzle tip for cleaning an inner surface of said nozzle tip and wherein said nozzle tip of said spray gun is branched into multiple parts.

18. The electrostatic powder coating apparatus according to claim 11, wherein said powder adhesion means is a flow of a vortex air supplied to said flow passage inside of said nozzle tip to effect, not only a function of cleaning an inner surface of said nozzle tip to remove adhered powder, but also a function of said means for pulverizing and dispersing said aggregated powder, and wherein said nozzle tip of said spray gun is branched into multiple parts.

19. The electrostatic powder coating apparatus according to claim 11, wherein said means for pulverizing and dispersing comprises an electrode cover disposed in a powder flow passage in said nozzle tip and a diffuser, said diffuser being continuously connected to said electrode cover and said diffuser having a fore end thereof positioned inside of a nozzle opening, and further comprising corona discharge means to which is applied a voltage with opposite polarity to a voltage applied to said spray gun in a direction of conveyance of said product to be coated.

20. The electrostatic powder coating apparatus according to claim 11, wherein said means for pulverizing and dispersing comprises a powder flow passage defined between an inner surface of said nozzle tip and an outer surface of said diffuser and gradually narrowing toward a nozzle opening, and vortex air introduction ports through which vortex air is supplied to a powder flow passing through said powder flow passage, and further comprising corona discharge means to which is applied a voltage with opposite polarity to a voltage applied to said spray gun in a direction of conveyance of said product to be coated.

21. The electrostatic powder coating apparatus according to claim 11, wherein said powder adhesion preventing means is compressed air supplied to said powder flow passage inside of said nozzle tip for cleaning an inner surface of said nozzle tip, and further comprising corona discharge means to which is applied a voltage with opposite polarity to a voltage applied to said spray gun in a direction of conveyance of said product to be coated.

22. The electrostatic powder coating apparatus according to claim 11, wherein said powder adhesion preventing means is a flow of a vortex air supplied to said powder flow passage inside of said nozzle tip to effect not only a function of cleaning an inner surface of said nozzle tip to removed adhered powder, but also a function of said means for pulverizing and dispersing said aggregated powder, and further comprising corona discharge means to which is applied a voltage with opposite polarity to a voltage applied to said spray gun in a direction of conveyance of said product to be coated.

* * * * *

UNITED STATES PATENT AND TRADEMARK OFFICE

CERTIFICATE OF CORRECTION

PATENT NO. : 5,915,621
DATED : June 29, 1999
INVENTOR(S) : Yanagida et al.

It is certified that error appears in the above-identified patent and that said Letters Patent is hereby corrected as shown below:

Column 11,
Line 25, change "$\eta=100(Pa/P_1)/T=100PA/(P_1T)$" to be -- $\eta=100(Pa/P_1)/T=100Pa/(P_1T)$ --.

Claim 8,
Line 5, change "....said nozzle tip to removed..." to be -- ... said nozzle tip to remove ... --

Claim 18,
Line 2, change "...powder adhesion means ..." to be -- ...powder adhesion preventing means... --.

Claim 22,
Line 5, change "...said nozzle tip to removed ..." to be -- ...said nozzle tip to remove... --.

Signed and Sealed this

Fifth Day of February, 2002

*Attest:*

*Attesting Officer*

JAMES E. ROGAN
*Director of the United States Patent and Trademark Office*